US007617791B2

(12) United States Patent
Gribble

(10) Patent No.: US 7,617,791 B2
(45) **Date of Patent: *Nov. 17, 2009**

(54) SIMULATED WOOD SURFACE COVERING FOR DECKS AND FLOORS

(75) Inventor: William R. Gribble, Bath, OH (US)

(73) Assignee: Plasteak, Inc., Copley, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/017,089

(22) Filed: Jan. 21, 2008

(65) Prior Publication Data

US 2009/0186192 A1 Jul. 23, 2009

(51) Int. Cl.
*B63B 5/08* (2006.01)

(52) U.S. Cl. ..... 114/85; 52/309.16; 52/592.1; 114/357

(58) Field of Classification Search ..... 52/578, 52/590.2, 591.2, 592.2, 592.6, 582.1, 586.1, 52/589.1, 309.16, 177; 114/85, 357; 523/171; 521/131; 156/78

See application file for complete search history.

(56) References Cited

U.S. PATENT DOCUMENTS

| | | | | |
|---|---|---|---|---|
| 4,141,944 | A * | 2/1979 | Anstadt et al. | 264/45.5 |
| 4,453,357 | A * | 6/1984 | Zwilgmeyer | 52/309.8 |
| 5,207,172 | A * | 5/1993 | Wolter | 114/357 |
| 6,804,926 | B1 | 10/2004 | Eisermann | |
| 6,811,628 | B1 | 11/2004 | Reid et al. | |
| 6,895,881 | B1 | 5/2005 | Whitaker | |
| 2005/0266200 | A1 | 12/2005 | Padmanabhan | |
| 2007/0022694 | A1 | 2/2007 | Chen et al. | |

FOREIGN PATENT DOCUMENTS

| | | | |
|---|---|---|---|
| CA | 988022 | A | 4/1976 |
| GB | 2365880 | | 2/2002 |
| WO | WO2006/102101 | A2 | 9/2006 |

OTHER PUBLICATIONS

Sales literature from Marinedeck® 2000 Exterior synthetic marine flooring.

* cited by examiner

*Primary Examiner*—Richard E Chilcot, Jr.
*Assistant Examiner*—Chi Q Nguyen
(74) *Attorney, Agent, or Firm*—Alvin T. Rockhill

(57) ABSTRACT

The present invention relates to a simulated wood surface covering which is particularly useful in decking and flooring applications, said simulated wood surface covering being comprised of strips adapted to be interconnected aside of each other thereby forming an assembled simulated wood surface covering of desired dimensions to cover a substrate, wherein the strips are adapted to be interconnected through shiplaps having tongues and rabbets, wherein the rabbets have an included angle which is within the range of 70° to 89°, wherein the strips are comprised of a plastic composition which is comprised of polyvinyl chloride, a non-migrating plasticizer, and a coloring agent, wherein the strips have sufficient flexibility to conform to curved surfaces and to surface irregularities, wherein the upper surface of the strips are roughened to imitate the grain structure of wooden material.

21 Claims, 5 Drawing Sheets

SIMULATED WOOD SURFACE COVERING FOR DECKS AND FLOORS

FIELD OF THE INVENTION

The present invention relates to a shape conforming simulated wood surface covering useful for covering a floor surface, such as a boat or yacht deck, floor boards in boats and yachts, bath and shower room floors, or swimming pool surroundings. The simulated wood surface coverings of this invention are formed of strips of a plastic composition which is comprised of polyvinyl chloride, a non-migrating plasticizer, and a coloring agent, wherein the strips have sufficient flexibility to conform to curved surfaces and to surface irregularities. The upper surface of the simulated wood surface is roughened to imitate the grain structure of wooden material, such as a deck made of teak, mahogany, or Oregon pine (wood of the Douglas fir).

BACKGROUND OF THE INVENTION

The decks of boats and yachts are frequently covered with wood, such as teak, mahogany, or Oregon pine. Teak wood is the most commonly used wood on pleasure boats for this purpose because it can typically be bent to conform to curved deck surfaces and to cover surface defects. Teak wood also provides a beautiful surface having relatively good anti-slip characteristics under both dry and wet conditions. Teak further offers the advantage of containing natural oils which help prevent it from rotting under the conditions of a marine environment, such as frequent exposure to water.

The naturally occurring oils in teak unfortunately cause it to turn grey or black over time. This is because mold and mildew feed upon the very oils that protect the teak wood from deterioration. A high level of maintenance is accordingly required to keep teak decks from discoloring due to the growth of mold and mildew. This optimally involves cleaning the teak wood to remove any mold or mildew causing discoloration at its first appearance and killing any remaining mold or mildew spores to inhibit further growth of the mold and mildew.

The most effective technique for cleaning teak wood is a three step process. The first step of the cleaning process normally involves the application of a relatively strong acid to remove the mold/mildew and to kill the spores associated with the therewith. Then, a neutralizer is applied and finally the teak is rinsed with clean water. This cleaning technique relies upon the use of a harsh acid that can damage the teak by raising the wood grain and making the surface of the wood rougher. Accordingly, the use of this technique normally reduces the service life of the teak deck.

A two step process can also be used to clean discolored teak wood decks. In this two-step technique a mild cleaner is worked into the teak wood with a bristle brush. The mild cleaner is then allowed to stand on the surface of the teak wood deck for a few minutes and then it is rinsed off. It is necessary to rub the surface of the teak deck with steel wool or a metal brush in the direction of the grain as the cleaner is being rinsed off. It is necessary to repeat this process on areas of the deck where stubborn discoloration persists. This two step process relies upon a tremendous amount of physical labor and can accurately be depicted as brutal work. It also can lead to deterioration of the teak due to the repeated rubbing action that is relied upon to adequately clean the wood.

After teak decks have been cleaned to remove mold and mildew they should be oiled and sealed to further improve their appearance. Organic oils are typically used for this purpose and replenish the oil lost to the environment and during the cleaning process. The oil will penetrate into the wood to help restore its original satiny finish. However, this oil provides more nutrients for the mold and mildew that caused the discoloration in the first place. In other words, the process of cleaning and oiling a teak deck develops into a never ending vicious cycle. To make matters worse teak decks require major work or replacement on the average of every four to six years.

U.S. Pat. No. 6,811,628 discloses a method of finishing a wood surface, such as teak or mahogany, for exterior exposure of the wood using a finishing film material in the form of a sheet. The finishing film comprises a flexible polymeric sheet material having a first major surface and a second major surface and a pressure sensitive adhesive layer covering at least a portion of the first major surface of the sheet material. The finishing film is adhered to the surface to the wood surface by the adhesive layer. This method is reported to be particularly suitable for the finishing of brightwork on boats, for example, teak or mahogany brightwork. The method of U.S. Pat. No. 6,811,628 is also reported to be particularly suitable for finishing curved and/or compound curved surfaces due to the flexibility and elongation of the finishing film.

U.S. Pat. No. 6,895,881 discloses a shape conforming surface covering useful for covering any type of surfaces, characterized in that the surface covering comprises planks or sheet of a flexible material adapted to be interconnected aside of each other thereby forming an assembled surface covering of optional length and width, and which planks are of a material that can be laid in curved formations, and which at the upper surface of the covering is roughened so as to imitate any unique grain effect of wooden material, further characterized in that the planks or sheet are formed with longitudinal slots at the underside thereof for facilitating forming of curved coverings and for acting as a base for a glue or adhesive material by means of which the surface covering is mounted on a surface recipient. U.S. Pat. No. 6,895,881 indicates that the planks can be made of a plastic or resin material, such as polyvinyl chloride, and can be made to imitate the color and grain structure of wooden material, such as teak, mahogany, pine, or redwood.

SUMMARY OF THE INVENTION

The simulated wood surface covering of this invention offers numerous advantages over conventional wooden coverings for utilization in covering the decks of boats and yachts. For instance, it is highly water resistant, easily washable (even with high pressure jet washers that damage conventional wood surfaces), stain resistant; mar and scuff resistant, easy to assemble; easy to lay on curved or irregular surfaces, and offers excellent anti-slip characteristics under both dry and wet conditions. It also offers a very low maintenance alternative to wood surfaces, such as teak wood. The simulated wood surface coverings of this invention can also be installed on the deck of a boat much more easily and with lower labor requirements than can the plastic surface coverings of the prior art. The installation of the simulated wood surface coverings of this invention on a curved or irregular surface is also a much more forgiving process.

The present invention more specifically discloses a simulated wood surface covering which is particularly useful in decking and flooring applications, said simulated wood surface covering being comprised of strips (planks) adapted to be interconnected aside of each other thereby forming an assembled simulated wood surface covering of desired dimensions to cover a substrate, wherein the strips are comprised of a plastic composition which is comprised of polyvinyl chloride, a non-migrating plasticizer, and a coloring agent, wherein the strips have sufficient flexibility to conform to curved surfaces and to surface irregularities, wherein the upper surface of the strips are roughened to imitate the grain structure of wooden material, wherein a pressure sensitive adhesive covers the underside of the strips, and wherein the pressure sensitive adhesive is covered by a backing so that the pressure sensitive adhesive is sandwiched between the strips and the backing.

The present invention further reveals a simulated wood surface covering which is particularly useful in decking and flooring applications, said simulated wood surface covering being comprised of strips adapted to be interconnected aside of each other thereby forming an assembled simulated wood surface covering of desired dimensions to cover a substrate, wherein the strips are comprised of a plastic composition which is comprised of polyvinyl chloride, a non-migrating plasticizer, and a coloring agent, wherein the strips have sufficient flexibility to conform to curved surfaces and to surface irregularities, wherein the upper surface of the strips are roughened to imitate the grain structure of wooden material, and wherein a fabric is bonded to the underside of the strips.

The subject invention also discloses a method of affixing a simulated wood surface covering to a deck of a boat which comprises providing (1) a simulated wood surface covering which is comprised of a simulated wood surface covering which is particularly useful in decking and flooring applications, said simulated wood surface covering being comprised of strips adapted to be interconnected aside of each other thereby forming an assembled simulated wood surface covering having the dimensions of the substrate, wherein the strips are comprised of a plastic composition which is comprised of polyvinyl chloride, a non-migrating plasticizer, and a coloring agent, wherein the strips have sufficient flexibility to conform to curved surfaces and to surface irregularities, wherein the upper surface of the planks are roughened to imitate the grain structure of wooden material, wherein a pressure sensitive adhesive covers the underside of the strips, and wherein the pressure sensitive adhesive is covered by a backing so that the pressure sensitive adhesive is sandwiched between the strips and the backing; (2) removing the backing from the underside of the strips; (3) laying the simulated wood surface onto the deck; and (4) pushing the simulated wood surface covering (which is typically in the form of a sheet) into the deck so that the pressure sensitive adhesive firmly adheres the simulated wood surface covering to the substrate.

The subject invention further reveals a simulated wood surface covering which is particularly useful in decking and flooring applications, said simulated wood surface covering being comprised of strips adapted to be interconnected aside of each other thereby forming an assembled simulated wood surface covering of desired dimensions to cover a substrate, wherein the strips are adapted to be interconnected through shiplaps having tongues and rabbets, wherein the rabbets have an included angle which is within the range of 70° to 89°, wherein the strips are comprised of a plastic composition which is comprised of polyvinyl chloride, a non-migrating plasticizer, and a coloring agent, wherein the strips have sufficient flexibility to conform to curved surfaces and to surface irregularities, wherein the upper surface of the strips are roughened to imitate the grain structure of wooden material.

The present invention also discloses a method of affixing a simulated wood surface covering to a substrate which comprises providing (1) a simulated wood surface covering which is comprised of a simulated wood surface covering which is particularly useful in decking and flooring applications, said simulated wood surface covering being comprised of strips adapted to be interconnected aside of each other thereby forming an assembled simulated wood surface covering having the dimensions of the substrate, wherein the strips are adapted to be interconnected through shiplaps having tongues and rabbets, wherein the rabbets have an included angle which is within the range of 70° to 89°, wherein there is a joint between the tongues and rabbets of the strips of the assembled simulated wood surface, wherein the strips are comprised of a plastic composition which is comprised of polyvinyl chloride, a non-migrating plasticizer, and a coloring agent, wherein the strips have sufficient flexibility to conform to curved surfaces and to surface irregularities, wherein the upper surface of the strips are roughened to imitate the grain structure of wooden material; (2) applying glue to the substrate and to the joint between the tongues and rabbets of interconnected strips; (3) laying the simulated wood surface onto the substrate; and (4) pushing the simulated wood surface covering into the deck so that the glue firmly adheres the simulated wood surface covering to the substrate. In such applications the substrate will commonly be the deck of a boat or flooring in proximity to a swimming pool.

DETAILED DESCRIPTION OF THE INVENTION

The simulated wood surface coverings of the present invention can be utilized as coverings in virtually any decking or flooring application. However, the simulated wood surface coverings of this invention are of particular value in decking and flooring applications where frequent exposure to water is contemplated. For instance, the simulated wood surface coverings of this invention can beneficially be utilized as the floor covering for bathrooms, shower rooms, swimming pool surroundings, and outdoor decks. The simulated wood surface coverings of the present invention are of particular value for covering the decks of boats. These simulated wood surface coverings can be used in covering deck surfaces on the exterior or in the interior of the boat. For instance, they can be used on the aft deck, forward deck, fly bridge deck, and cockpit deck, side deck walkways, interiorly on the floors in the salon and galley, and on any other exterior or interior deck surfaces.

Figure 1:
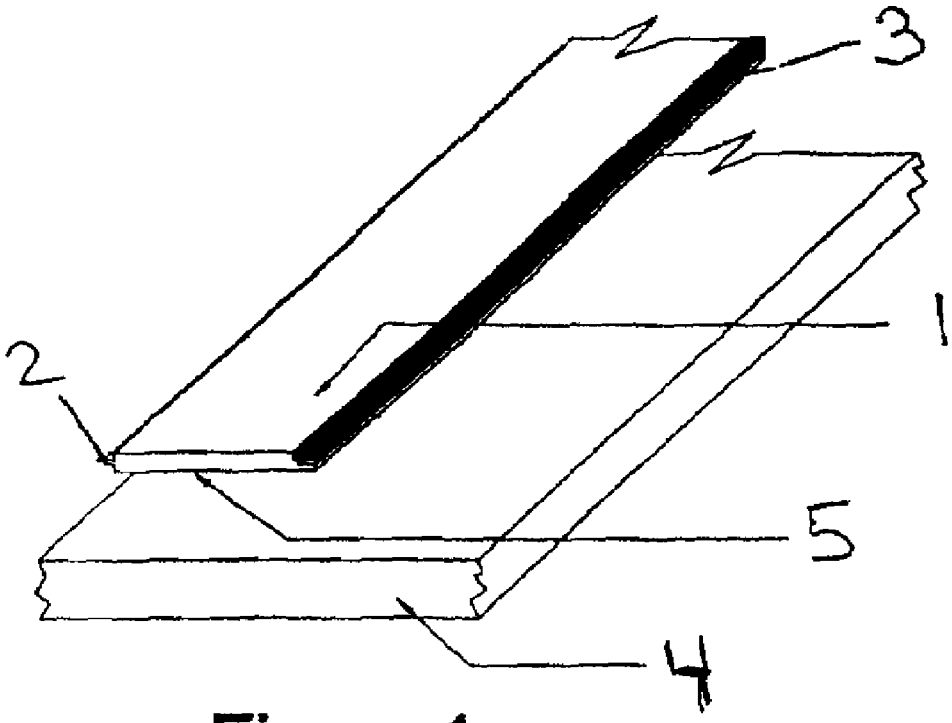
FIG. 1 is a fragmentary perspective view of a strip of simulated wood surface covering which is affixed to a substrate, such as the deck of a boat, with a pressure sensitive adhesive.

The simulated wood surface covering is comprised of strips that are adapted to be interconnected at their sides to form an assembled simulated wood surface covering of the desired dimensions to cover a substrate such as a deck of a boat. The strips can be designed to include tongues and grooves to facilitate their interconnection in a side by side manner. Such a strip 1 is shown in FIG. 1 wherein the strip includes a tongue 2 and a groove 3. The strips can also be adapted to allow for them to be welded together through the application of heat. In any case, the strips are adapted to be connected edge to edge in any desired combination to form the desired size and shape of the surface to be covered. These strips have sufficient flexibility to allow for them to bend and conform to curved substrate surfaces. In some cases it is desirable to heat the strips to an elevated temperature so that they are more malleable in cases where the strips need to be bent significantly. Since the strips of this invention provide excellent flexibility, it is typically not necessary to include seams for caulking to attain a relatively stress free surface. Accordingly, the simulated wood surface coatings of this invention normally have simulated caulking strips for aesthetic purposes. These strips can be designed to be of a different color imitating seams of the type used in applying wooden decks on a boat. The color of such stripes will typically be black or some other color which can be easily controlled through the use of a pigment or colorant such as carbon black or titanium dioxide.

The strips will typically be manufactured by the extrusion of a plastic composition. These strips will preferably include a matching locking means along the longitudinal edges thereof, preferably a groove (mortise) and tenon means. Such a design is typically preferable in "do it yourself" applications. However, in professional operations it is typically preferred to weld the individual strips together in forming the simulated wood surface covering of the desired size and shape.

The plastic composition utilized in manufacturing the strips is comprised of polyvinyl chloride (PVC), a non-migrating plasticizer, and a coloring agent (an organic compound or an inorganic pigment). A streaking agent can also be added to the plastic composition to provide the simulated wood surface with a more realistic appearance. The non-migrating plasticizer can be selected from an array of suitable materials. For instance, the non-migrating plasticizer can be a polymer prepared by reacting one or more dicarboxylic acids with one or more glycols. Such polymeric plasticizers can be synthesized by reacting a dicarboxylic acid containing from about 5 to about 10 carbon atoms with a glycol containing from 2 to about 4 carbon atoms. For instance, suitable polymeric plasticizers can be made by reacting phthalic acid, isophthalic acid, terephthalic acid, glutaric acid, adipic acid, azelaic acid or sebacic acid with ethylene glycol or propylene glycol. These polymeric non-migrating plasticizers will typically have a viscosity which is within the range of about 1,000 cps to about 160,000 cps. Liquid copolymers of acrylonitrile and 1,3-butadiene (liquid NBR) can also be beneficially utilized as non-migrating plasticizers in the practice of this invention. Tri(ethylhexyl)trimellitate (TEHTM) is another representative example of a non-migrating plasticizer that can be used in the practice of this invention. It is typically preferred to utilize a powdered nitrile rubber as the non-migrating plasticizer.

The non-migrating plasticizer will typically be present in the plastic composition at a level which is within the range of about 5 php to about 60 php (parts per hundred parts by weight of plastic). At levels of less than about 5 php, strips of the simulated wood do not have sufficient flexibility to bend around curved surfaces or to conform to irregular surfaces. On the other side of the coin, at levels of greater than about 60 php the composition becomes too soft and is not durable enough for utilization as a flooring material. It is typically preferred for the non-migrating plasticizer to be present in the plastic composition at a level which is within the range of about 10 php to about 30 php.

The plastic composition will also typically contain at least one antifungal agent (fungicide). Some representative types of anti-fungal agents that can be utilized include organo-copper compounds, organo-tin compounds, chlorinated phenols, and pentachlorophenol esters. Some specific examples of fungicides that can be used include copper naphthenate, copper-8-hydroxyquinolinate and pentachlorophenyl laurate. Irgaguard® F 3000 organic fungicide from Ciba Specialty Chemicals is specifically designed for inhibiting the growth of mold and mildew on polymer surfaces, such as PVC surfaces. The anti-fungal agent will typically be utilized in the plastic composition at a level which is within the range of about 0.5 php to about 2 php.

One or more thermal stabilizers can also be added to the plastic composition in an amount which is typically within the range of about 0.1 php to about 1 php to prevent thermal degradation during processing and throughout the service life of the simulated wood surface covering. The thermal stabilizer will typically be an organometallic salt of tin, lead, barium, cadmium, calcium or zinc. Since the simulated wood surface may be exposed to prolonged periods of harsh sunlight, an ultraviolet light stabilizer can also beneficially be utilized in the plastic composition. Benzophenones, benzotriazoles and substituted acrylonitriles are suitable for utilization as ultraviolet light stabilizers in polyvinyl chloride-based plastic compositions.

After being extruded a pressure sensitive adhesive and adhesive backing is applied to the underside of the strips. Accordingly, the pressure sensitive adhesive is sandwiched between the underside of the simulated wood surface covering and the backing. The backing keeps the adhesive from sticking to any surfaces or articles before the time that it is desired to affix the simulated wood surface covering to a substrate. This allows for the surface covering to be stored and transported without it sticking to unintended objects. This peel and stick adhesive system eliminates the need for applying an adhesive to the underside of the simulated wood surface covering at the point of installation to a substrate, such as a boat deck. This in turn reduces labor requirements and the cost of applying the simulated wood surface covering to a deck. The use of such a peel and stick pressure sensitive adhesive system is of particular benefit in the manufacture of new boats and yachts having uniform and consistent deck surfaces.

It is highly desirable for the adhesive to be applied to the back of the simulated wood surface covering as a composite which is comprised of the backing, the adhesive, and a carrier layer. Typically a second layer of adhesive will be applied to the opposite side of the carrier layer to enable it to be bonded to the back of the simulated wood surface covering. Such a composite adhesive structure offers the advantage of being able to reposition the surface covering after it is initially positioned on a substrate for a short period of time. This is because the adhesive composite is initially bonded much more strongly to the simulated wood surface covering than it is to the substrate (boat deck surface) to which it is being applied. It normally takes about 24 hours for the adhesive to fully cure to the substrate onto which it is being applied.

Figure 5:
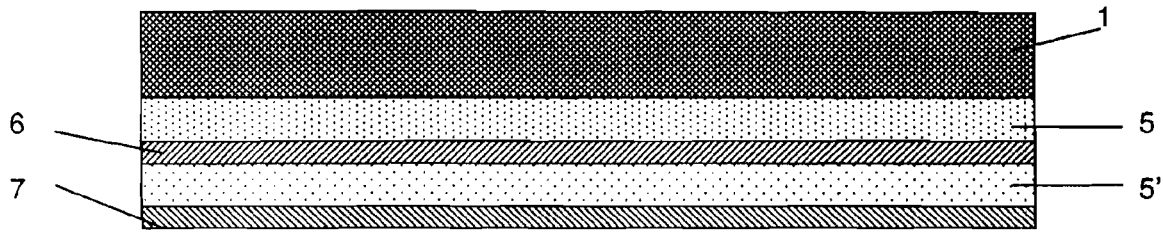
FIG. 5 is a cross-sectional view of a simulated wood surface covering having a carrier layer for the adhesive used therein.

As illustrated in FIG. 5 the simulated wood strip 1 has a first layer of an adhesive 5, a carrier layer 6, a second layer of adhesive 5', and a layer of backing 7 bonded to the underside thereof. Typically, the carrier layer will be comprised of a thin film of a polymeric material, such as a polyester. The first layer of adhesive 5 will typically be about 0.1 mils to about 5 mil thick, the carrier layer will be about 0.1 mils to 1 mil thick, and the second layer of adhesive 5' will be about 1 mil to about 10 mils thick. It is typically preferred for the first layer of adhesive 5 to be about 0.3 mils to about 2 mils thick, for the carrier layer will be about 0.3 mils to 0.7 mils thick, and for the second layer of adhesive will be about 2 mils to about 5 mils thick.

The PVC strips initially have a very smooth, somewhat shiny surface which does not have the appearance or feel of wood. Accordingly, the upper surface of the extruded strips is roughened to provide the appearance and feel of real wood. This can be accomplished by sanding the upper surface of the plastic strips with coarse sandpaper in a direction which is parallel to the length of the strips. This provides the strips with a natural grain appearance that runs in the direction parallel to the length of the strips. It is preferred to utilize a 36 grit sandpaper to accomplish this objective. This gives the imitation wood the texture and appearance of real wood. This rough texture is not slippery to walk on even with bare feet under dry or wet conditions. Additionally, it is mar and scuff resistant and cannot normally be hurt by hard soled shoes or high heels.

In another embodiment of this invention, the simulated wood surface covering is designed with the replacement of deteriorated wooden decks on older boats and yachts in mind. In such applications it is common for the deck of the boat to have an irregular surface after the deteriorated wood deck covering has been removed. Such applications optimally call for a more forgiving simulated wood surface covering. In this embodiment of the invention a fabric is bonded to the underside of the strips of the simulated wood surface covering. This can be accomplished by extruding the molten plastic strips onto the fabric or by heating the plastic and pushing the fabric into the soft plastic material while it is at an elevated temperature to attain good adhesion between the fabric and the plastic strips. In this embodiment of the invention, an adhesive is applied to the fabric on the underside of the simulated wood surface coating and then the surface coating is applied to the desired substrate. The fabric is typically made from a synthetic polymer such as polyester or nylon. The fabric can optionally include an array of small hooks (as is found the on pieces of Velcro fabric that stick to a corresponding fabric of small loops).

In still another embodiment of this invention which is of particular value in manufacturing new boats and yachts, a high pressure laminate is bonded to the underside of the strips of the simulated wood surface covering. High pressure laminates prove to be useful in improving installation time of strips of both the welded and shiplap designs. The high pressure laminate can be bonded to the strips with glue or pressure sensitive adhesive. This reduces the time necessary for the simulated wood surface covering to bond to the substrate on which it is applied, such as a boat deck. This is beneficial in many commercial applications because it makes it possible for workers to walk on the new simulated wood surface covering sooner and to perform other manufacturing functions at an earlier point in time than would other wise be possible. In any case, these high pressure laminates are typically composites of paper or fabric with a melamine resin. The melamine resin is a hard, thermosetting plastic made by the polymerization of melamine and formaldehyde. High pressure laminates that are suitable for use in the practice of this invention are available from a variety of commercial sources and are sold as Formica® laminates and Arborite® laminates. The high pressure laminate will typically have a thickness which is within the range of 0.175 inch to 0.250 inch and will more typically have a thickness which is within the range of 0.185 inch to 0.200 inch.

Figure 2:
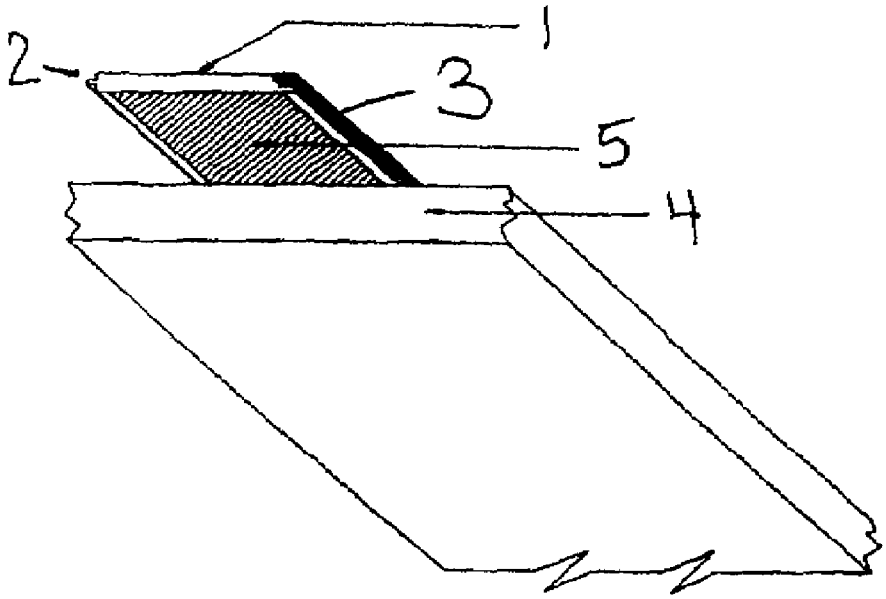
FIG. 2 is a fragmentary perspective view of a strip of simulated wood surface covering which is affixed to a substrate, and which shows the pressure sensitive adhesive which is sandwiched between the strip and the substrate to affix the strip to the substrate.

FIG. 1 illustrates a simulated wood surface covering of this invention that includes a strip 1 that is adapted to be interconnected to additional strips by a tongue 2 and a groove 3. The strips will be cut to a length that matches the length of the substrate 4 being covered and a sufficient number of strips will be bonded together to provide a surface having the width of the substrate 4 being covered. An adhesive 5 is utilized to securely bond the strips to the substrate 4. FIG. 2 shows the adhesive 5 which was applied to the underside of the strip 1 of simulated wood.

Figure 3:
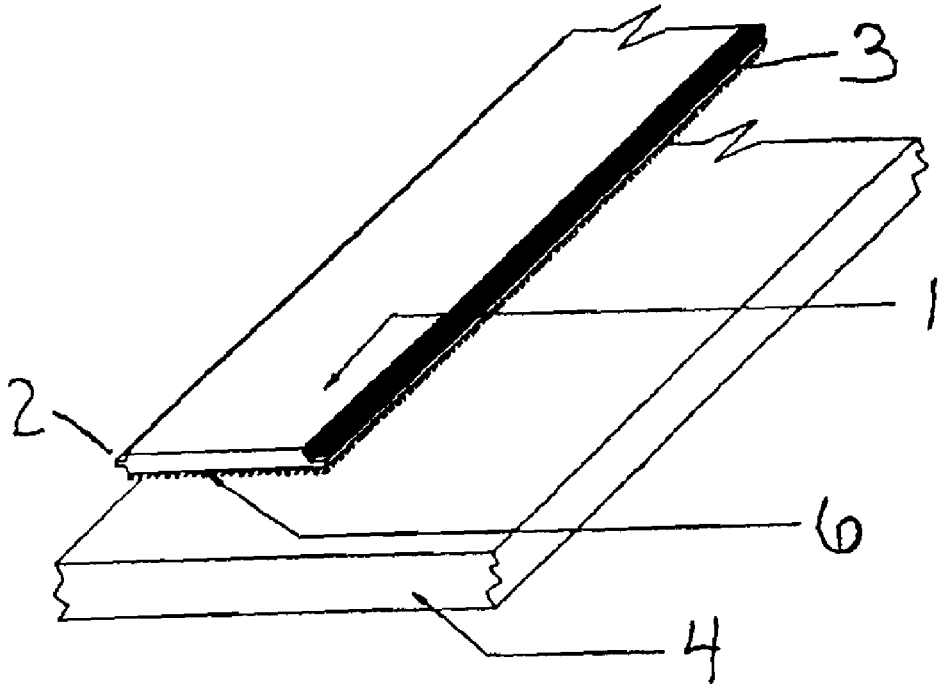
FIG. 3 is a fragmentary perspective view of a strip of simulated wood surface covering which is affixed to a substrate wherein a fabric layer is sandwiched between the strip and the substrate to compensate for surface irregularities on the substrate.
Figure 4:
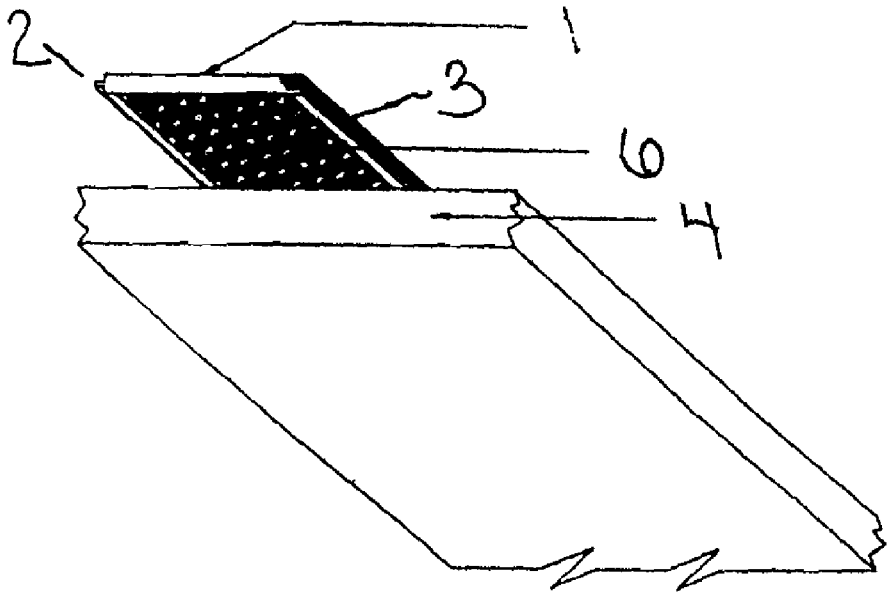
FIG. 4 is a fragmentary perspective view of a strip of simulated wood surface covering which is affixed to a substrate and which shows a fabric layer that is sandwiched between the strip and the substrate to compensate for surface irregularities on the substrate.

FIGS. 3 and 4 illustrates a simulated wood surface covering of this invention that includes a strip 1 that is adapted to be interconnected to additional strips by a tongue 2 and a groove 3. The strips will be cut to a length that matches the length of the substrate 4 being covered and a sufficient number of strips will be bonded together to provide a surface having the width of the substrate 4 being covered. A fabric 6 is utilized to make the simulated wood strip 1 conform to the surface of the substrate 4. An adhesive is applied to the fabric 6 and then it is applied to the substrate 4 to attain good adhesion between the simulated wood strip 1 and the substrate 4.

Figure 6:
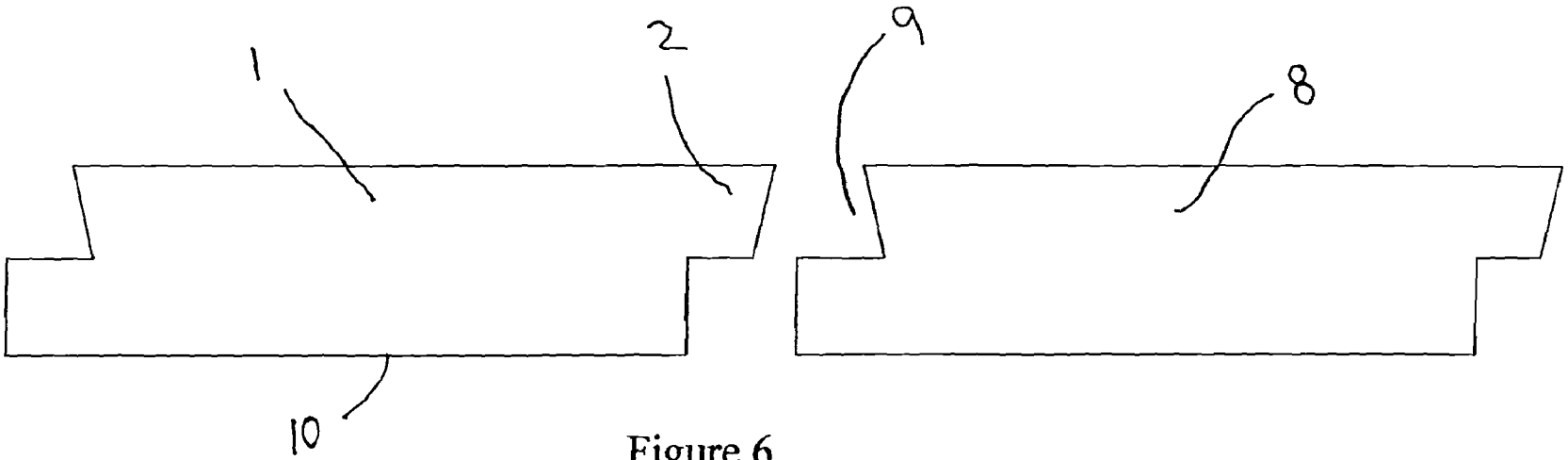
FIG. 6 is a perspective end view of two strips of simulated wood surface covering of a preferred shiplap design that are oriented for interconnection to form an assembled simulated wood surface covering on a substrate, such as the deck of a boat.
Figure 8:
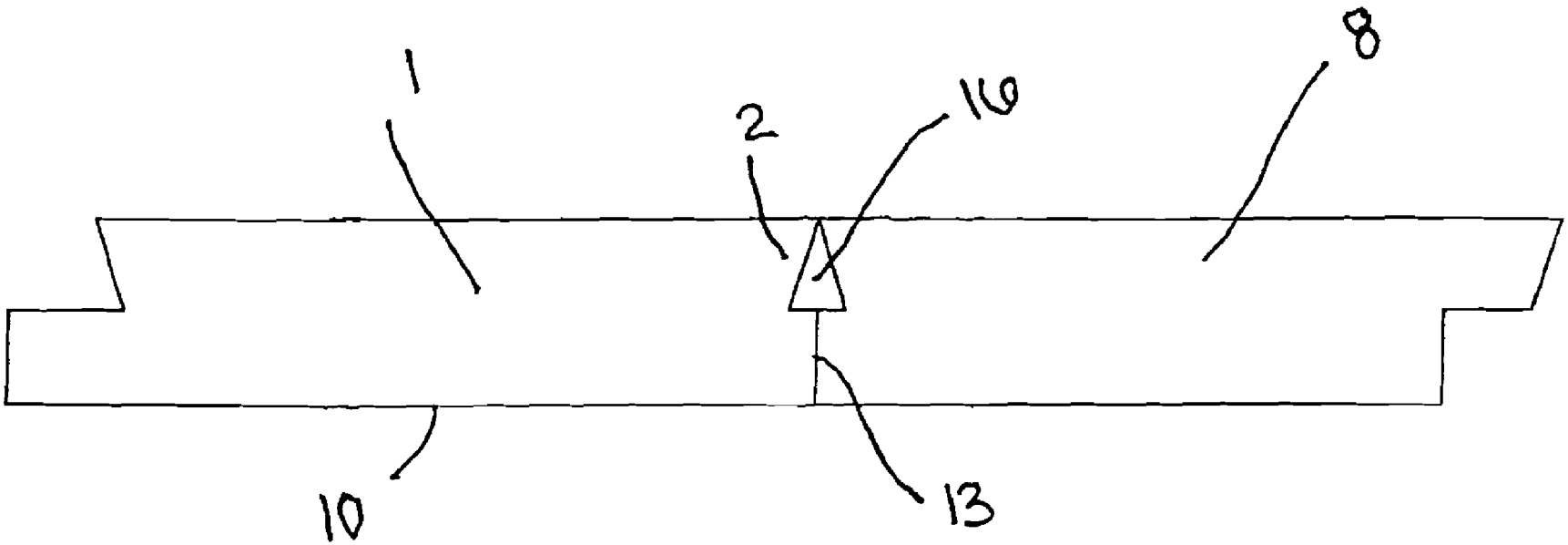
FIG. 8 is a perspective end view of two strips of simulated wood surface covering of a preferred shiplap design that are interconnected to form an assembled simulated wood surface covering on a substrate.

FIG. 6 illustrates a first strip 1 of the simulated wood surface covering of this invention that is adapted to be interconnected to a second strip 8 of simulated wood surface covering by a rabbet joint to make a shiplap structure. The first strip 1 has a tongue 2 that overlaps the second strip 8 and extends into the rabbet 9 of the second strip to form a rabbet joint when the strips are interconnected. After being interconnected the tongue of the first strip extends into the rabbet (rebate) of the second strip to make a flush joint as shown in FIG. 8. The strips will be cut to a length that matches the length of the substrate being covered and a sufficient number of strips will be bonded together to provide a surface having the width of the substrate being covered. A fabric or high pressure laminate can optionally be applied to the underside 10 of the strips to allow for the simulated wood strips to better conform to the surface of the substrate to which they are being applied. An adhesive is applied to the underside of the strips or to the fabric on the underside of the strips to adhere the simulated wood covering to a substrate, such as the deck of a boat.

Figure 7:
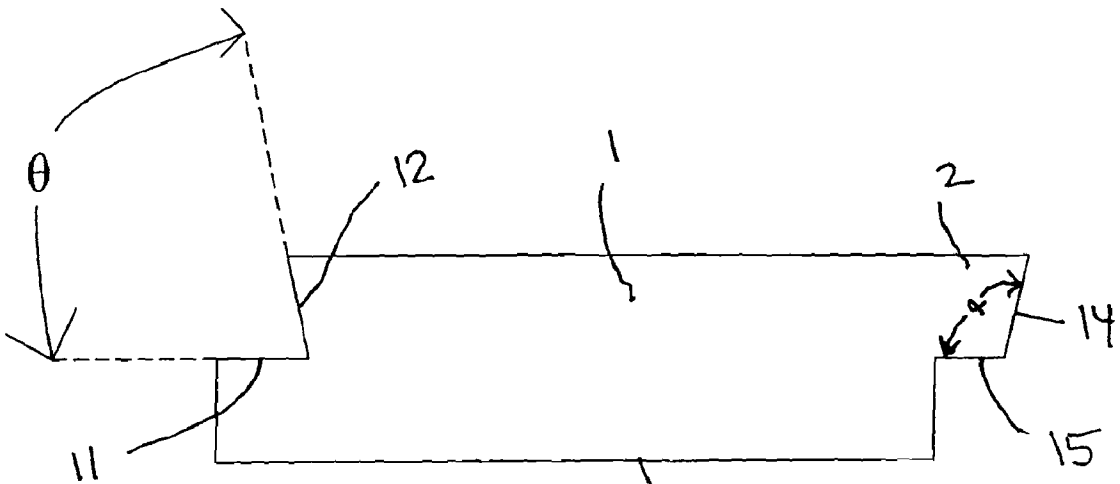
FIG. 7 is a perspective end view of a strip of simulated wood surface covering of a preferred design showing the angle θ, at which the grooves of the shiplaps project into the body of the simulated wood strips. The angle θ has been exaggerated in FIGS. 6 and 7 for ease of illustration.

FIG. 7 illustrates a strip 1 for interconnection to other strips through rabbet joints to make a simulated wood structure of shiplap design. It should be noted that the rabbet forms an included angle θ, wherein θ is within the range of 70° to 89°. The angle θ will typically be within the range of 80° to 89° and will more typically be within the range of 85° to 88°. The horizontal surface 11 of the rabbet will normally be parallel to the underside 10 of the strip 1. The tongue 2 of the strips will normally have a vertical tongue wall 14 that makes an includes angle, α, with the bottom wall of the underside of the tongue 15. The included angle, α, will typically be within the range of 91° to 110°. The angle α will more typically be within the range of 91° to 100° and will preferably be within the range of 92° to 95°. Thus, on being interconnected there will be an interstice 16 (void space) within the rabbet joint where excess glue can agglomerate as illustrated in FIG. 8. It should be noted that in making simulated wood surface coverings that glue is applied both to the underside of the strips and at the interface of the rabbet joints.

The simulated wood surface coverings of the present invention are highly resistant to aqueous fluids. Water and other aqueous fluids do not normally damage or permanently stain the simulated wood surface coverings of this invention. However, in some cases it may be desirable to treat the outer surface of the simulated wood surface covering with a chemical/oil resistant protective coating. A water based penetrating sealer can be used for this purpose. The water based penetrating sealer used for this purpose can be comprised of water, an aqueous fluorochemical solution, a fluoropolymer dispersion, and one or more alcohols, such as 2-butoxyethenol and/or isopropanol.

This invention is illustrated by the following examples that are merely for the purpose of illustration and are not to be regarded as limiting the scope of the invention or the manner in which it can be practiced. Unless specifically indicated otherwise, parts and percentages are given by weight.

EXAMPLE 1

A plastic composition that contains 200 parts by weight of polyvinyl chloride resin, about 20 parts by weight of powdered nitrite rubber (as a non-migrating plasticizer), about 2 parts by weight of a brown colorant, about 0.2 parts by weight of a streaking agent, about 1 part by weight of Irgaguard® F 3000 organic fungicide, and about 1 part by weight of benzotriazole ultraviolet light stabilizer can be extruded into plastic strips that are adapted to be interconnected from side to side. As the strips are being extruded, a pressure sensitive adhesive and backing are applied to the underside of the strips to produce a peel and stick type of structure. This allows for the simulated wood surface covering having the pre-applied pressure sensitive adhesive to be stored and shipped without sticking to any other object or surface before being applied to the boat deck.

These plastic strips can then be sanded with 36 grit sandpaper in the longitudinal direction to attain a surface having the texture of wood. The desired number of strips of desired length can then be glued or welded together side by side to attain a simulated wood surface. This simulated wood surface can then be cut to the desired dimensions of a boat deck to which it will be applied.

The simulated wood surface covering is then transported to be within proximity to the boat deck to which it will be applied. The backing is then removed from the surface covering to expose the pressure sensitive adhesive and the simulated wood surface is carefully positioned above and lowered onto the surface of the boat deck to which it is being applied.

This technique eliminated the need to apply an adhesive to the underside of the covering at the site of application to the boat deck. This greatly reduced labor requirements and can lead to a more uniform result since the pressure sensitive adhesive is applied to the simulated wood structure at the factory where it is produced.

EXAMPLE 2

A plastic composition that contains 100 parts by weight of polyvinyl chloride resin, about 30 parts by weight of powdered nitrile rubber (as a non-migrating plasticizer), about 3 parts by weight of a brown colorant, about 0.4 parts by weight of a streaking agent, about 1 part by weight of Irgaguard® F 3000 organic fungicide, and about 1 part by weight of a benzophenone ultraviolet light stabilizer can be extruded into plastic strips that are adapted to be interconnected from side to side by a mortise and tenon means. After being extruded while the plastic composition is still hot and soft a polyester fabric can be pushed into the underside of the strips. After the plastic composition is allowed to cool the polyester fabric is well bonded into the underside of the plastic strips.

The top side of these plastic strips can then be sanded with 36 grit sandpaper in the longitudinal direction to attain a surface having the texture of wood. The strips can then be glued side by side to a boat deck to provide a simulated wood surface. Since the plastic strips are somewhat flexible they can be easily bent to conform to curves on the surface of the boat deck. The polyester fabric on the underside of the strips helps to compensate for defects and surface irregularities of the deck of the boat. The polyester fabric also greatly improves the bonding between the substrate and the simulated wood surface covering.

This technique is extremely forgiving and is designed to be used by non-professionals in resurfacing the decks of their boats. The strips of simulated wood offer good flexibility and are easy to assemble and lay on curved or even irregular surfaces. After being laid on the deck of a boat the simulated wood surface covering offers the advantages of being highly water resistant, easily washable (even with high pressure jet washers that damage conventional wood surfaces), stain resistant; mar and scuff resistant, and offers excellent anti-slip characteristics under both dry and wet conditions. It also requires virtually no maintenance to maintain and will not rot or deteriorate.

EXAMPLES 3-6

In this series of experiments simulated wood surface coverings having different types of surface textures on the bottom surface thereof were tested to determine the relationship between surface texture and adhesion to a substrate. The type surface texture on the bottom surface of the simulated wood surface coverings evaluated in this series of experiments is depicted in Table I. In the procedure used the bottom surface of the simulated wood surfaces was totally covered with an acrylic adhesive and the then applied to a plywood substrate. In all cases the adhesive was allowed to fully cure to the plywood substrate. Then the strength of the adhesion of the simulated wood surface covering to the plywood substrate was tested. This was done by measuring the force that needed to be applied to pull the simulated wood surface covering from the plywood substrate. The results of this experiment are reported in Table I.

TABLE I

| Example | Surface Texture | Strength of Adhesion |
|---|---|---|
| 3 | Dovetail | 40-45 pounds |
| 4 | Diamond point | 20 pounds |
| 5 | smooth | 50 pounds |
| 6 | Sanded Rough | 20 pounds |

As can be seen from Table I, the simulated wood surface covering having the smooth surface texture on the bottom thereof exhibited the highest level of adhesive strength to the plywood substrate. In fact, the plywood substrate broke apart and delaminated when a force of about 50 pounds was applied rather than the simulated wood surface covering being pulled from it. In other words, the adhesion of the simulated wood surface covering to the plywood substrate was stronger than the adhesion between the layers of wood structure in the plywood. Unexpectedly, the smooth surface provided stronger adhesion than did the rough surface, the diamond point surface pattern, or the dovetail design.

EXAMPLE 7

In this experiment a simulated wood surface covering for a boat deck was fabricated by welding strips of simulated wood sheet together utilizing PVC welding rod. The simulated wood surface covering was made of the design and shape needed to cover the deck of the boat. A pressure sensitive acrylic adhesive having a backing covering its entire outer surface was applied to the bottom surface of the simulated wood surface covering. The simulated wood surface covering having the pressure sensitive acrylic adhesive backing was then applied to the original deck surface of a new boat. This was accomplished by removing the backing from the simulated wood surface covering to expose the acrylic adhesive. Then, the simulated wood surface covering was positioned as desired above the boat deck and then lowered into position onto the boat deck surface. Pressure was applied to the simulated surface covering to firmly secure it to the boat deck. The simulated wood surface covering adhered well to the boat deck and provided the desired aesthetically pleasing simulated wood surface.

Repositioning was difficult or impossible in cases where the simulated wood surface was lowered onto the boat deck in a manner wherein it was initially out of the desired position. Accordingly, it is important to initially position such simulated wood surface covering into the exact desired position on the boat deck surface before the exposed adhesive on the back of the simulated wood surface covering comes into contact with the boat deck.

EXAMPLE 8

In this experimental procedure a simulated wood surface covering was again applied to a boat deck surface as in Example 7. However, the simulated wood surface covering used in this procedure was designed so that the pressure sensitive adhesive was supported by carrier layer with the carrier layer being positioned between the acrylic adhesive and the simulated wood structure. The simulated wood structure was of the design depicted in FIG. 5 wherein the first layer of adhesive 5 was about 2 mils thick, wherein the carrier 6 was a polyester film that was about 0.5 mils thick, and wherein the second layer of adhesive 5' was about 2 mils thick.

In cases where the simulated wood surface covering was initially positioned inaccurately to the boat deck surface it was possible to easily remove the simulated wood surface covering from the boat deck surface and to properly reposition it. This is because the adhesion between the first layer of adhesive and the carrier layer was much stronger than the adhesion that was initially attained between the second layer of adhesive and the boat deck surface. However, it is still important to reposition the simulated wood surface covering onto the boat deck surface as soon as possible after it is initially applied out of the desired position. It should be noted that it takes about 24 hours for the acrylic adhesive to fully cure (wet out) to attain essentially full strength. In any case, the utilization of the polyester carrier layer made the application of the simulated wood surface to the boat deck a much more forgiving process.

EXAMPLE 9

In this experiment a simulated wood surface covering for a boat deck was fabricated utilizing simulated wood strips having a conventional shiplap stricture. The strips were glued together along their rabbet joints and were further glued to the deck of the boat. The simulated wood surface covering adhered well to the boat deck. However, the tongues of the rabbet joints tended to leave an open gap on the surface between the strips which resulted in an uneven and aesthetically undesirable surface appearance. In some cases an uneven surface resulted as a consequence of this tendency for gaps to occur between the strips.

EXAMPLE 10

In this experiment a simulated wood surface covering for a boat deck was fabricated utilizing simulated wood strips having a modified shiplap structure. In this modified shiplap structure the rabbets formed an included angle (θ in FIG. 7) of about 87°. The strips were glued together along their rabbet joints and were further glued to the deck of the boat. The simulated wood surface covering adhered well to the boat deck and the tongues of the rabbet joints did fit together forming uniform seams without gaps forming between the strips. This resulted in an even deck surface having a smooth and aesthetically pleasing surface appearance. This can be contrasted to the undesirable result experienced with the conventional shiplap structure employed in Example 9 where the included angle formed by the rabbets was essentially 90°.

While certain representative embodiments and details have been shown for the purpose of illustrating the subject invention, it will be apparent to those skilled in this art that various changes and modifications can be made therein without departing from the scope of the subject invention.

What is claimed is:

1. A simulated wood surface covering which is particularly useful in decking and flooring applications, said simulated wood surface covering being comprised of strips adapted to be interconnected aside of each other thereby forming an assembled simulated wood surface covering of desired dimensions to cover a substrate, wherein the strips are adapted to be interconnected through shiplaps having tongues and rabbets, wherein there is an interstices between the tongues and rabbets, wherein the rabbets have an included angle which is within the range of 70° to 89°, wherein the strips are comprised of a plastic composition which is comprised of polyvinyl chloride, a non-migrating plasticizer, and a coloring agent, wherein the strips have sufficient flexibility to conform to curved surfaces and to surface irregularities, wherein an upper surface of the strips are roughened to imitate a grain structure of wooden material.

2. The simulated wood surface covering as specified in claim 1 wherein the strips do not include longitudinal slots.

3. The simulated wood surface covering as specified in claim 1 wherein the non-migrating plasticizer is a powdered nitrile rubber.

4. The simulated wood surface covering as specified in claim 1 wherein the non-migrating plasticizer is present at a level which is within the range of about 5 to about 60 parts by weight per 100 parts by weight of plastic.

5. The simulated wood surface covering as specified in claim 1 wherein the non-migrating plasticizer is a liquid copolymer of acrylonitrile and 1,3-butadiene.

6. The simulated wood surface covering as specified in claim 1 wherein a fabric is bonded to an underside of the strips.

7. The simulated wood surface covering as specified in claim 1 wherein the strips are glued together.

8. The simulated wood surface covering as specified in claim 7 wherein glue is utilized to interconnected the tongues and rabbets of the strips.

9. The simulated wood surface covering as specified in claim 7 wherein glue is present in the interstices between the tongues and rabbets of the strips.

10. The simulated wood surface covering as specified in claim 1 wherein the plastic composition is further comprised of a streaking agent.

11. The simulated wood surface covering as specified in claim 1 wherein the upper surface of the strips are roughened by sanding with a sandpaper of 40 grit or lower.

12. The simulated wood surface covering as specified in claim 1 wherein an upper surface of the strips are roughened by sanding with a sandpaper of 35 grit or lower.

13. The simulated wood surface covering as specified in claim 1 wherein the upper surface of the strips are roughened by sanding with 36 grit sandpaper.

14. The simulated wood surface covering as specified in claim 1 wherein the plastic composition is further comprised of an anti-fungal agent.

15. The simulated wood surface covering as specified in claim 1 wherein the plastic composition is further comprised of an ultra violet light stabilizer.

16. The simulated wood surface covering as specified in claim 1 wherein the non-migrating plasticizer is present at a level which is within the range of about 10 to about 30 parts by weight per 100 parts by weight of plastic.

17. The simulated wood surface covering as specified in claim 1 wherein the simulated wood surface covering is glued to the deck of a boat.

18. The simulated wood surface covering as specified in claim 1 wherein the rabbets have an included angle which is within the range of 80° to 89°.

19. The simulated wood surface covering as specified in claim 1 wherein the rabbets have an included angle which is within the range of 85° to 88°.

20. A method of affixing a simulated wood surface covering to a substrate which comprises providing (1) a simulated wood surface covering which is comprised of a simulated wood surface covering which is particularly useful in decking and flooring applications, said simulated wood surface covering being comprised of strips adapted to be interconnected aside of each other thereby forming an assembled simulated wood surface covering having the dimensions of the substrate, wherein the strips are adapted to be interconnected through shiplaps having tongues and rabbets, wherein the rabbets have an included angle which is within the range of 70° to 89°, wherein there is a joint between the tongues and rabbets of the strips of the assembled simulated wood surface, wherein the strips are comprised of a plastic composition which is comprised of polyvinyl chloride, a non-migrating plasticizer, and a coloring agent, wherein the strips have sufficient flexibility to conform to curved surfaces and to surface irregularities, wherein an upper surface of the strips are roughened to imitate a grain structure of wooden material; (2) applying glue to the substrate and to the joint between the tongues and rabbets of interconnected strips; (3) laying the simulated wood surface onto the substrate; and (4) pushing the simulated wood surface covering into the deck so that the glue firmly adheres the simulated wood surface covering to the substrate.

21. A simulated wood surface covering which is particularly useful in decking and flooring applications, said simulated wood surface covering being comprised of strips adapted to be interconnected aside of each other thereby forming an assembled simulated wood surface covering of desired dimensions to cover a substrate, wherein the strips are adapted to be interconnected through shiplaps having tongues and rabbets, wherein there is an interstices between the tongues and rabbets, wherein the rabbets have an included angle which is within the range of 70° to 89°, wherein the strips do not include longitudinal slots, wherein the strips are comprised of a plastic composition which is comprised of polyvinyl chloride, a non-migrating plasticizer, and a coloring agent, wherein the non-migrating plasticizer is present at a level of at least about 5 php to provide the strips with sufficient flexibility to bend around curved surfaces and to conform to irregular surfaces, wherein an upper surface of the strips are roughened to imitate a grain structure of wooden material, and wherein a bottom surface of the strips have a smooth surface.

* * * * *